US007553597B2

(12) United States Patent
Kobayashi et al.

(10) Patent No.: US 7,553,597 B2
(45) **Date of Patent: *Jun. 30, 2009**

(54) CARRIER CORE MATERIAL, COATED CARRIER, AND TWO-COMPONENT DEVELOPING AGENT FOR ELECTROPHOTOGRAPHY

(75) Inventors: Hiromichi Kobayashi, Kashiwa (JP); Issei Shinmura, Kashiwa (JP); Tsuyoshi Itagoshi, Kashiwa (JP); Yuji Sato, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 349 days.

This patent is subject to a terminal disclaimer.

(21) Appl. No.: 10/773,559

(22) Filed: Feb. 6, 2004

(65) Prior Publication Data

US 2004/0229151 A1 Nov. 18, 2004

(30) Foreign Application Priority Data

Feb. 7, 2003 (JP) ..... 2003-031407

(51) Int. Cl.
*G03G 9/107* (2006.01)

(52) U.S. Cl. ..... 430/111.3; 430/111.31; 430/111.32; 430/111.33; 430/111.34; 430/111.35

(58) Field of Classification Search ..... 430/111.3, 430/111.31, 111.32, 111.33, 111.34, 111.35
See application file for complete search history.

(56) References Cited

U.S. PATENT DOCUMENTS 4,598,034 A 7/1986 Honjo et al.
5,061,586 A 10/1991 Saha et al.
5,268,249 A * 12/1993 Saha et al. ..... 430/111.33
5,439,771 A * 8/1995 Baba et al. ..... 430/111.31
5,466,552 A 11/1995 Sato et al.
5,576,133 A * 11/1996 Baba et al. ..... 430/111.31

(Continued)

FOREIGN PATENT DOCUMENTS

EP 0 928 998 A1 7/1999

(Continued)

OTHER PUBLICATIONS

U.S. Appl. No. 10/774,045.*

(Continued)

*Primary Examiner*—Hoa V Le
(74) *Attorney, Agent, or Firm*—The Webb Law Firm

(57) ABSTRACT

A carrier core material containing at least one metal oxide ($M^LO$) having a melting point of not higher than 1000° C. and at least one metal oxide ($M^HO$) having a melting point of not lower than 1800° C., wherein the metal ($M^H$) for constituting the metal oxide ($M^HO$) has an electrical resistivity of not less than $10^{-5}$ Ω·cm. Also disclosed is a two-component developing agent comprising a coated carrier, which comprises the carrier core material coated with a resin, and toner particles. Further disclosed is an image forming method comprising developing an electrostatic latent image formed on a photosensitive member with the two-component developing agent using an alternating electric field. The carrier core material and the coated carrier have high magnetization and are free from occurrence of leakage of electric charge over a wide range of electric field from low electric field to high electric field. According to the two-component developing agent, an excellent image can be formed.

18 Claims, 2 Drawing Sheets

U.S. PATENT DOCUMENTS

| | | | | | |
|---|---|---|---|---|---|
| 5,637,431 | A | * | 6/1997 | Yamane et al. | 430/108.2 |
| 5,686,012 | A | * | 11/1997 | Hayashi et al. | 252/62.56 |
| 5,688,852 | A | * | 11/1997 | Misawa et al. | 524/431 |
| 5,795,693 | A | * | 8/1998 | Okado et al. | 430/109.4 |
| 5,843,610 | A | * | 12/1998 | Uchida et al. | 430/106.2 |
| 5,874,019 | A | * | 2/1999 | Uchida et al. | 252/62.59 |
| 5,876,893 | A | * | 3/1999 | Ochiai et al. | 430/111.33 |
| 5,900,343 | A | * | 5/1999 | Ochiai et al. | 430/111.33 |
| 5,976,747 | A | | 11/1999 | Sato et al. | |
| 5,994,019 | A | | 11/1999 | Okado et al. | |
| 5,998,076 | A | * | 12/1999 | Mahabadi et al. | 430/111.32 |
| 6,090,517 | A | | 7/2000 | Tamura et al. | |
| 6,157,801 | A | * | 12/2000 | Aita et al. | 399/175 |
| 6,165,663 | A | * | 12/2000 | Baba et al. | 430/111.3 |
| 6,232,026 | B1 | * | 5/2001 | Lambert | 430/111.33 |
| 6,316,156 | B1 | * | 11/2001 | Takiguchi et al. | 430/109.4 |
| 6,372,400 | B1 | | 4/2002 | Yoshizaki et al. | |
| 6,548,218 | B1 | * | 4/2003 | Kukimoto et al. | 430/123.41 |
| 6,571,077 | B2 | * | 5/2003 | Thompson et al. | 399/267 |
| 6,627,369 | B2 | * | 9/2003 | Kobayashi et al. | 430/111.32 |
| 6,686,113 | B2 | * | 2/2004 | Kobayashi et al. | 430/111.33 |
| 6,723,481 | B2 | * | 4/2004 | Lambert et al. | 430/122.3 |
| 2002/0037470 | A1 | * | 3/2002 | Takiguchi et al. | 430/111.33 |
| 2003/0122918 | A1 | * | 7/2003 | Ikeda et al. | 347/140 |
| 2003/0207193 | A1 | * | 11/2003 | Meyer et al. | 430/122 |

FOREIGN PATENT DOCUMENTS

| | | | |
|---|---|---|---|
| EP | 1 065 571 | A2 | 1/2001 |
| JP | 59-48774 | A | 3/1984 |
| JP | 59-228664 | A | 12/1984 |
| JP | 60000458 | A | 1/1985 |
| JP | 5-197214 | A | 8/1993 |
| JP | 5-505891 | A | 8/1993 |
| JP | 6-35231 | A | 2/1994 |
| JP | 6-51563 | A | 2/1994 |
| JP | 7098521 | A | 4/1995 |
| JP | 7-181744 | A | 7/1995 |
| JP | 7-333910 | A | 12/1995 |
| JP | 8006302 | A | 1/1996 |
| JP | 8022150 | A | 1/1996 |
| JP | 8-69131 | A | 3/1996 |
| JP | 8-194338 | A | 7/1996 |
| JP | 08-202084 | A | 8/1996 |
| JP | 9-236947 | A | 9/1997 |
| JP | 10-039548 | A | 2/1998 |
| JP | 11-190916 | A | 7/1999 |
| JP | 2000-267360 | A | 9/2000 |

OTHER PUBLICATIONS

*Metal Data Book*, 3rd ed., Oct. 10, 2000, p. 13, pub. Maruzen Co., Ltd.

*Chemical Data Book* 3, Sep. 30, 1960, 1st ed., select pages, pub. Kyoritsu Shuppan Co., Ltd.

* cited by examiner

CARRIER CORE MATERIAL, COATED CARRIER, AND TWO-COMPONENT DEVELOPING AGENT FOR ELECTROPHOTOGRAPHY

BACKGROUND OF THE INVENTION

1. Field of the Invention

The present invention relates to a carrier core material for a two-component developing agent used for developing an electrostatic latent image formed by electrophotography or electrostatic printing, a coated carrier comprising the carrier core material coated with a resin, a two-component developing agent containing the coated carrier, and an image forming method in which the two-component developing agent can be preferably employed.

2. Description of Related Art

An electrophotographic developing method is a method for developing a latent image formed on a photosensitive member by allowing toner particles of a developing agent to adhere to the latent image. The developing agents employable in this method are divided into two-component developing agents containing toner particles and carrier particles and mono-component developing agents containing toner particles only.

As a developing method using the two-component developing agent containing toner particles and carrier particles, a cascade method was used formerly, but at the present time, a magnetic brushing method using a magnetic roll is mainly used.

The carrier particle in the two-component developing agent is a carrier material, which is stirred together with the toner particles in a development box filled with the developing agent to impart desired electric charge to the toner particles and carries the charged toner particles onto the surface of a photosensitive member to form a toner image on the photosensitive member. The carrier particles held by a magnet and remaining on a developing roll return to the development box again from the developing roll and are mixed and stirred with new toner particles. Thus, the carrier particles are repeatedly used for a certain period of time.

In the two-component developing agent, the carrier particles have functions of electrostatically charging the toner particles when they are mixed and stirred with the toner particles and carrying the toner particles, differently from the mono-component developing agent, and such a two-component developing agent has good controllability in the designing of the developing agent. Therefore, the two-component developing agent is suitable for a full color developing apparatus requiring high image quality and a high-speed printing apparatus requiring reliability of image retention and durability.

In the two-component developing agent used as above, it is necessary that image properties, such as image density, fog, white spot, gradation and resolution, exhibit given values from the initial stage and these properties do not vary in the period of printing impression and stably maintained. For stably maintaining these properties, it becomes necessary that the properties of the carrier particles contained in the two-component developing agent are stable.

As the carrier particles for forming the two-component developing agent, an iron powder carrier such as an oxide-coated iron powder or a resin-coated iron powder has been conventionally used. The reason is that such an iron powder carrier has high magnetization and high electrical conductivity, so that an image having good reproducibility of a solid portion can be easily obtained. The iron powder carrier, however, is heavy in its self-weight and has too high magnetization. Therefore, extremely heavy stirring stress is applied to the toner particles in the development box, and the toner is fused to the surface of the iron powder carrier, that is, so-called toner spent is liable to occur. If the toner spent occurs, an effective surface area of the carrier is decreased, and thereby triboelectric effect (frictional charging power) due to the carrier and the toner particles tends to lower. In case of the resin-coated iron powder carrier, the resin coating is liable to peel off by the endurance stress. If the resin coating peels off, the core material (iron powder) having high electrical conductivity and low dielectric breakdown voltage is exposed, and the electrostatic latent image formed on the photosensitive member is broken by the leakage of electric charge. As a result, brush streaks are produced on the solid portion, and it becomes difficult to obtain a uniform image, that is, the resin-coated iron carrier has poor durability. For these reasons, the iron powder carriers such as the oxide-coated iron powder and the resin-coated iron powder are rarely used at present.

Instead of the oxide-coated iron powder or the resin-coated iron powder, for example, resin-coated carriers of soft ferrite, such as Cu—Zn ferrite or Ni—Zn ferrite, have been used as described in a Japanese Patent Laid-Open Publication No. 48774/1984. Because the resin-coated carrier using soft ferrite as a core material has low magnetization, a head of the developing magnetic brush can be made soft, and hence, reproducibility of vertical and horizontal lines of the resulting image becomes good.

Further, because the resin-coated carrier using soft ferrite as a core material has high dielectric breakdown voltage, leakage of electric charge rarely occurs and an image of high quality can be formed.

With increase of image quality and precision of development box, reduction of particle size of not only carrier particles but also toner particles is promoted, and toner particles having an average particle diameter of 5 to 10 μm have been mainly used as the toner particles. Further, study of use of toner particles having an average particle diameter of not more than 5 μm in the future has been started.

In order to impart desired electric charge to the toner particle of such a small diameter by friction, the carrier particle needs to have a high specific surface area, and the size of the carrier particle has been reduced. More specifically, spherical ferrite having an average particle diameter of 35 to 60 μm has been used.

Separately from the above improvements in the two-component developing agents themselves, the environment where the two-component developing agents are used has changed, and the two-component developing agents have been modified correspondingly to the change of the environment.

For example, the development system has shifted from an analog system to a digital system, or also in ordinary offices, networking has been promoted, and full color images hitherto used in the restricted sections only have been generally used recently. The full color image has a larger image area as compared with a black-and-white image generally used hitherto, and hence it is necessary to further improve properties of a solid portion and a halftone portion, such as uniformity, gradation and resolution.

In order to improve uniformity, gradation and resolution of the solid portion and the halftone portion or in order to increase a moving speed of the toner, it is advantageous to use, as the image forming method, a method of superposing AC bias on DC bias when the developing bias is applied from the magnetic brush to the, electrostatic latent image side, namely, a method of using an alternating electric field.

In the developing method using an alternating electric field, an alternating current electric field is superposed on a direct current electric field, and consequently, a strong electric field is momentarily applied to the developing agent. Because of the alternating electric field thus applied, leakage of electric charge is liable to occur, and the electrostatic latent image formed is liable to be disordered. Especially when a conventional developing agent is used, image defects such as unevenness and white spots tend to be produced in the solid portion or the halftone portion.

In order to inhibit the leakage of electric charge in a high electric field such as the alternating electric field thus applied, it is necessary to prevent dielectric breakdown of the carrier particles, and it is desirable to use, as the carrier particles, a carrier having a resin coating layer on a surface of a carrier core material. However, the amount of the resin used for the resin coated carrier is relatively small, and the thickness of the resin coating layer is thin, and besides the carrier core material is not always completely coated with the resin. Therefore, even if such a resin coating layer is formed, the leakage of electric charge is not completely prevented by the resin coating layer. That is to say, by coating the carrier particle with a resin, the carrier particle exhibits high electrical resistance in a low electric field, but in a high electric field, leakage of electric charge sometimes takes place because of an influence by the core material itself. Especially when a core material of low electrical resistance, such as iron powder or magnetite, is used as the carrier core material, such tendency is markedly observed. Further, even if the conventional Cu—Zn ferrite particles or Ni—Zn ferrite particles and the ferrite particles described in Japanese Patent Laid-Open Publication No. 69131/1996, which are considered to have relatively high dielectric breakdown voltage, are used, it is difficult to obtain uniform and faithful image reproducibility in the existing circumstances.

Japanese Patent Laid-Open Publication No. 51563/1994 and Japanese Patent Laid-Open Publication No. 35231/1994 disclose that if the magnetization of a carrier is weakened to, for example, about 30 to 150 emu/cm$^3$, the magnetic brush becomes soft in the magnetic field at the development pole and an image faithful to the latent image can be obtained. Although the magnetic brush becomes soft and a relatively good image tends to be obtained by weakening the magnetization of the carrier as described above, image reproducibility of high level that is required with the recent increase of image quality is not satisfied.

Japanese Patent Laid-Open Publication No. 181744/1995 discloses an electrophotographic carrier obtained by treating the surface of a carrier core material with a partial hydrolysis sol such as Zr alkoxide in coating the surface of the carrier core material. This publication discloses that the thus formed coating layer is extremely hard and does not peel off during the period of service, so that a stable image can be formed. In the recent compact developing apparatus suffering heavy developing stress, however, the carrier cannot have sufficient durability in many cases, for example, because of peeling of the coating layer, the carrier core material is exposed to cause leakage of electric charge.

Japanese Patent Laid-Open Publication No. 197214/1993 discloses a carrier having a carrier core material whose surface is coated with a polyolefin resin containing carbon black, said earner core material being obtained by contacting a surface of a carrier core material with a high-activity catalyst component comprising Ti or Zr in a hydrocarbon solvent and polymerizing an olefin monomer onto the surface. In this publication, it is described that this carrier is excellent in durability, resistance to stress and resistance to environment. The carrier described in this publication, however, is a coated carrier wherein the surface of a carrier core material is coated with polyolefin, and in a high-speed apparatus suffering heavy stress, the surface coating peels off, so that sufficient durability is not obtained.

Japanese Patent Laid-Open Publication No. 194338/1996 discloses a ferrite carrier containing a specific component that is added for the purposes of maintaining high charging property of the toner and preventing adhesion of carrier and unevenness of density to improve color developing stability. In this publication, there is also disclosed a carrier wherein an oxide containing at least one element selected from Groups IA, IIA, IIIA, IVA, VA, IIIB and VB of the periodic table is added to a ferrite carrier component containing a specific component in order to control a degree of crystal growth or irregularity of a particle surface and in order to control particle density. In the case of randomly selecting such an element to be added, however, it is impossible to inhibit leakage of electric charge in a high electric field with keeping high magnetization. Further, it is very difficult to inhibit leakage of electric charge and to ensure uniformity of the solid and halftone portions in an alternating electric field or a high electric field only by such operations of controlling a degree of crystal growth or irregularity of a particle surface and controlling particle density as described in this publication. That is to say, this publication is not intended to inhibit leakage of electric charge in a high electric field, does not suggest anything about it and is entirely different from the present invention.

Japanese Patent No. 3168377 discloses that high image qualities, such as high image density, excellent highlight reproducibility and excellent fine line reproducibility, can be achieved by the use of a carrier having specific carrier resistance and specific fluidity. In this publication, it is also disclosed that this carrier is characterized in that the resistance of the carrier core material is increased by adding $Bi_2O_3$, so that when it is not added, the resistance becomes low, and if it is added too much, a uniform ferrite phase including a surface cannot be obtained. As a result, stabilization of charging of the toner cannot be achieved. Such a high-resistance carrier that is considered to be obtainable only by the addition of $Bi_2O_3$, cannot have sufficient strength against the leakage of electric charge, and besides, it is difficult to sufficiently inhibit disorder of a latent image because of low dielectric breakdown voltage. Moreover, the uniform ferrite including the surface, which is considered as excellent in this publication, cannot prevent a phenomenon of leakage of electric charge particularly in a high electric field. Hence, this carrier cannot meet the requirements of the recently increased high image qualities.

OBJECTS OF THE INVENTION

It is an object of the present invention to provide a carrier core material capable of forming an electrophotographic carrier which can form an image excellent in faithful reproducibility of halftone, gradation, resolution and uniformity in the solid printing and can maintain high image qualities for a long period of time.

It is another object of the present invention to provide a resin-coated electrophotographic carrier which can form an image excellent in faithful reproducibility of halftone, gradation, resolution and uniformity in the solid printing and can maintain high image qualities for a long period of time.

It is a further object of the present invention to provide a developing agent for electrophotography, which can form an image excellent in faithful reproducibility of halftone, gradation, resolution and uniformity in the solid printing and can maintain high image qualities for a long period of time.

It is a still further object of the present invention to provide an image forming method wherein an electrostatic latent image formed on a photosensitive member is developed in an alternating electric field by the use of the above-mentioned developing agent.

SUMMARY OF THE INVENTION

The carrier core material according to the present invention is a carrier core material containing at least one metal oxide ($M^LO$) having a melting point of not higher than 1000° C. and at least one metal oxide ($M^HO$) having a melting point of not lower than 1800° C., wherein the metal ($M^H$) for constituting the metal oxide ($M^HO$) has an electrical resistivity of not less than $10^{-5}$ Ω·cm.

The coated carrier according to the present invention is a coated carrier comprising a carrier core material and a resin coating layer with which the carrier core material is coated, wherein the carrier core material contains at least one metal oxide ($M^LO$) having a melting point of not higher than 1000° C. and at least one metal oxide ($M^HO$) having a melting point of not lower than 1800° C., and the metal ($M^H$) for constituting the metal oxide ($M^HO$) has an electrical resistivity of not less than $10^{-5}$ Ω·cm.

The two-component developing agent for electrophotography according to the present invention comprises the above-mentioned coated carrier and toner particles having an average particle diameter of 3 to 15 μm.

The image forming method according to the present invention comprises developing an electrostatic latent image formed on a photosensitive member by the use of the above-mentioned two-component developing agent for electrophotography in an alternating electric field.

In the coated carrier formed by the use of the carrier core material of the present invention, at least two kinds of metal oxides having different melting points are contained in the carrier core material. By controlling the contents of these metal oxides, a coated carrier free from leakage of electric charge even in a high electric field and having high magnetization can be prepared.

By the use of the two-component developing agent using the coated carrier free from leakage of electric charge even in a high electric field and having high magnetization, an image can be efficiently formed in the image forming method using an alternating electric field.

DETAILED DESCRIPTION OF THE INVENTION

Figure 1:
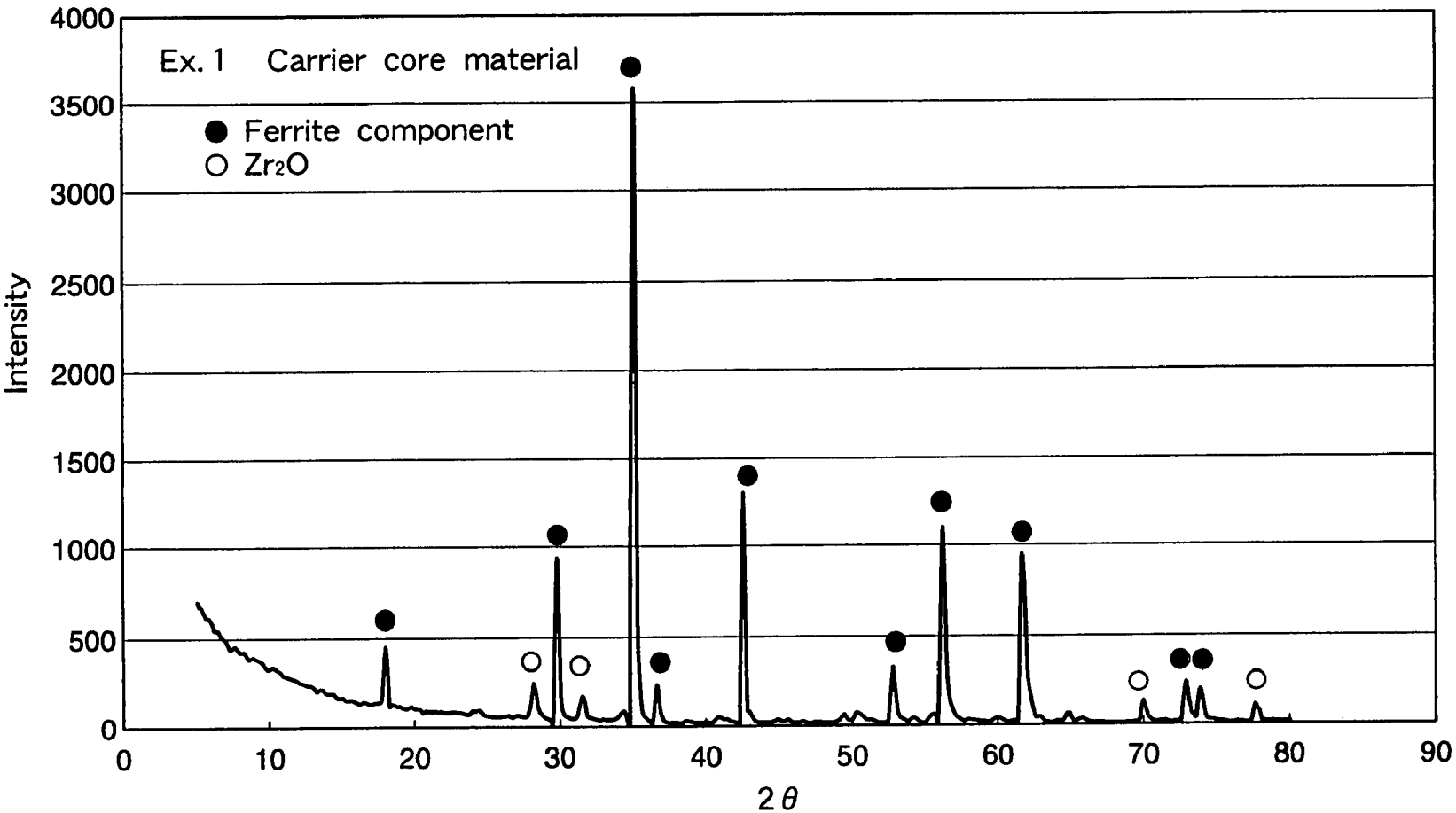
FIG. 1 is a view showing an X-ray diffraction chart of an embodiment of a carrier core material of the present invention, in which the high-melting point oxide ($M^HO$) appears as a peak of an element that is not ferrite.

The carrier core material for an electrophotographic developing agent, the coated carrier, the two-component developing agent and the image forming method according to the present invention are described in detail hereinafter.

The carrier core material of the invention is a carrier core material containing at least one metal oxide ($M^LO$) having a melting point of not higher than 1000° C. and at least one metal oxide ($M^HO$) having a melting point of not lower than 1800° C., wherein the metal ($M^H$) for constituting the metal oxide ($M^HO$) has an electrical resistivity of not less than $10^{-5}$ Ω·cm.

That is to say, in the carrier core material of the invention, at least two kinds of metal oxides having different melting points are contained in a ferrite component. In the ferrite component for constituting the carrier core material, a part of the metal oxide ($M^HO$) is preferably independently present without forming a solid solution with the ferrite component.

The low-melting point oxide ($M^LO$) contained in the carrier core material of the invention is an oxide having a melting point of not higher than 1000° C. In the present invention, the melting point of the low-melting point oxide ($M^LO$) is in the range of preferably 550 to 900° C., particularly preferably 600 to 850° C. By the use of the low-melting point oxide ($M^LO$) having such a melting point, the high-melting point oxide ($M^HO$) can be dispersed inside the particle.

Examples of the low-melting point oxides ($M^LO$) include PbO, $Bi_2O_3$, $Sb_2O_3$, $V_2O_5$ and $P_2O_5$. These low-melting point oxides ($M^LO$) can be used singly or in combination. In the present invention, it is preferable to use $Bi_2O_3$, $Sb_2O_3$, $P_2O_5$ and $V_2O_5$ singly or in combination as the low-melting point oxide, ($M^LO$). It is more preferable to use $Bi_2O_3$, $P_2O_5$ and $V_2O_5$ singly or in combination as the low-melting point oxide ($M^LO$).

The low-melting point oxide ($M^LO$) is contained in an amount of more than 0% by weight and not more than 12% by weight, preferably 0.01 to 10% by weight, more preferably 0.02 to 3% by weight, in the ferrite (100 parts by weight) for forming the carrier core material. If the amount of the low-melting point oxide ($M^LO$) in the carrier core material of the invention exceeds 12% by weight, magnetization is markedly decreased, so that such an amount is unfavorable. In the carrier core material of the invention, the low-melting point oxide ($M^LO$) is contained as an essential component in the ferrite component, and the content of the low-melting point oxide ($M^LO$) may-be an extremely slight amount. However, the low-melting point oxide ($M^LO$) is preferably contained in an amount of not less than 0.01% by weight in the carrier core material of the invention, whereby the carrier core material of the invention has higher magnetization and exhibits such excellent electrical properties that it brings about no leakage of electric charge even in a high electric field.

The high-melting point oxide ($M^HO$) contained in the carrier core material of the invention is an oxide having a melting point of not lower than 1800° C. In the present invention, the melting point of the high-melting point oxide ($M^HO$) is in the range of preferably 1800 to 3500° C., particularly preferably 1850 to 3300° C. By the use of the high-melting point oxide ($M^HO$) having such a melting point, at least a part of the high-melting point oxide ($M^HO$) can be independently dispersed inside the particle without forming a solid solution with the ferrite component for constituting the carrier core material.

In the present invention, the metal ($M^H$) for constituting the high-melting point oxide ($M^HO$) has an electrical resistivity of usually not less than $10^{-5}$ Ω·cm, preferably not less than $3\times10^{-5}$ Ω·cm, particularly preferably not less than $4\times10^{-5}$ Ω·cm. By the use of the metal ($M^H$) having such a high electrical resistivity; the high-melting point oxide ($M^HO$) that is an oxide of this metal depresses electrical conductivity to inhibit leakage of electric charge. If the electrical resistivity is less than $10^{-5}$ Ω·cm, an effect of inhibiting leakage of electric charge in a high electric field cannot be obtained sufficiently. The electrical resistivity of the metal ($M^H$) for constituting the high-melting point oxide ($M^HO$) is based on "Metal Data Book" (edited by The Japan Institute of Metals).

At least a part of the high-melting point oxide ($M^HO$) is allowed to be present in the ferrite component without forming a solid solution, and thereby the electrical conductivity can be more effectively depressed to inhibit leakage of electric charge. The above effect can be obtained by the use of the high-melting point oxide ($M^HO$) in combination with the low-melting point oxide ($M^LO$). The reason is as follows. In the sintering process of the ferrite, the low-melting point oxide ($M^LO$) is melted to allow a liquid phase to appear and thereby promote crystal growth, and during the crystal growth, the high-melting point oxide ($M^HO$) is dispersed inside the particle, but a part of it comes to be present in the grain (particle) boundary phase. By virtue of such an effect, the high-melting point oxide ($M^HO$) constituted of the metal ($M^H$) having high electrical resistivity can enhance insulating properties of the particle boundary phase, and consequently the coated carrier formed by the use of the carrier core material of the invention comes to have such excellent electrical properties that it brings about no leakage of electric charge over a wide range of electric field from low electric field to high electric field.

By allowing the high-melting point oxide ($M^HO$) to be independently present in the ferrite component without forming a solid solution as described above, the high-melting point oxide ($M^HO$) has a function of depressing electrical conductivity among crystals of the ferrite, and there can be prepared a carrier core material capable of forming a coated carrier which is free from leakage of electric charge even in a high electric field in spite of the fact that it has high magnetization. Especially when the high-melting point oxide ($M^HO$) is allowed to be present inside the particle of the carrier core material in a concentration higher than that in the vicinity of the particle surface of the carrier core material, a phenomenon of leakage of electric charge in a high electric field can be inhibited by the contribution of the resistance inside the particle, and there can be obtained a carrier core material suitable for preparing a coated carrier having higher magnetization and free from leakage of electric charge in a high electric field. It is important that the high-melting point oxide ($M^HO$) that is present independently as described above is contained together with the low-melting point oxide ($M^LO$), and by the control of the content of the high-melting point oxide ($M^HO$), it becomes possible to disperse the high-melting point oxide ($M^HO$) inside the particle and to control the concentration thereof in the vicinity of the particle surface. Consequently, the carrier core material of the invention becomes suitable for forming a coated carrier having high magnetization and rarely suffering leakage of electric charge over a wide range of electric field from low electric field to high electric field even if the resin coating is abraded by the printing impression.

Examples of the high-melting point oxides ($M^HO$) include $ZrO_2$, TiO, $Ti_2O_3$, $TiO_2$ and $Ta_2O_5$. These high-melting point oxides ($M^HO$) can be used singly or in combination. In the present invention, it is preferable to use $ZrO_2$, $TiO_2$ and $Ta_2O_5$ singly or in combination as the high-melting point oxide ($M^HO$). It is more preferable to use $ZrO_2$ as the high-melting point oxide ($M^HO$).

The high-melting point oxide ($M^HO$) is contained in an amount of more than 0% by weight and not more than 12% by weight, preferably 0.01 to 10% by weight, more preferably 0.02 to 3% by weight, in the ferrite (100 parts by weight) for forming the carrier core material. If the amount of the high-melting point oxide ($M^HO$) contained in the carrier core material of the invention exceeds 12% by weight, magnetization is markedly decreased, so that such an amount is unfavorable. In the carrier core material of the invention, the high-melting point oxide ($M^HO$) is contained as an essential component in the ferrite component, and the content of this high-melting point oxide ($M^HO$) may be an extremely slight amount. However, the high-melting point oxide ($M^HO$) is preferably contained in an amount of not less than 0.01% by weight in the carrier core material of the invention, whereby the carrier core material of the invention has higher magnetization and exhibits such excellent electrical properties that it brings about no leakage of electric charge even in a high electric field.

That the high-melting point oxide ($M^HO$) is dispersed independently in the ferrite without forming a solid solution is made clear by the fact that a peak of an element that is not ferrite is detected by X-ray diffractometry, as shown in FIG. 1.

In the present invention, it is preferable that in the ferrite component for forming the carrier core material and represented by the following formula (A):

$$(MO)_y(Fe_2O_3)_z \quad (A)$$

wherein y and z are each expressed in % by mol and are numbers satisfying the conditions of $40 \leqq z < 100$ and $y+z=100$, M is a metal selected from Fe, Cu, Zn, Mn, Mg, Ni, Sr, Ca and Li, and MO is one or more oxides selected from oxides of these metals, a low-melting point oxide ($M^LO$) and a high-melting point oxide ($M^HO$) each of which is selected from metal oxides other than the metal oxide (MO) are contained.

In the ferrite, magnetization and resistance can be easily controlled to be in the desired ranges, and the high-melting point oxide ($M^HO$) rarely forms a solid solution with the low-melting point oxide ($M^LO$). In the above ferrite compositional formula, z is not less than 40% by mol and less than 100% by mol. In order that the carrier core material forms an excellent ferrite structure and the effects of the low-melting point oxide ($M^LO$) and the high-melting-point oxide ($M^HO$) are readily obtained, $Fe_2O_3$ is desirably contained in an amount of 40 to 90% by mol in the carrier core material. If the amount thereof is less than 40% by mol, particles of low magnetization are liable to be produced to thereby cause carrier adhesion. MO is preferably one oxide or a combination of two or more oxides selected from the group consisting of FeO, MnO, MgO, CaO, $Li_2O$ and SrO. These oxides are easily controllable in the magnetization, and by the use these oxides, the effects of the low-melting point oxide ($M^LO$) and the high-melting point oxide ($M^HO$) can be particularly easily obtained.

If $SiO_2$ is contained in the carrier core material of the invention, the aforesaid functions of the low-melting point oxide ($M^LO$) and the high-melting point oxide ($M^HO$) are hindered, and it becomes difficult to uniformly and effectively form an insulating particle boundary phase. As a result, leakage of electric charge is hardly inhibited. Moreover, magnetization (Ms) is lowered, and residual magnetization (Mr) and coercive force (Hc) tend to become too high. In the present invention, therefore, it is preferable to add no $SiO_2$.

In the carrier core material of the invention, the amounts of the low-melting point oxide ($M^LO$) and the high-melting point oxide ($M^HO$) are controlled so that the low-melting point oxide ($M^LO$)/the high-melting point oxide ($M^HO$) weight ratio in the carrier core material should be in the range of usually 0.01 to 50, preferably 0.05 to 20, particularly preferably 0.1 to 10. If the ratio is lower than the lower limit of the above range, the amount of the low-melting point oxide ($M^LO$) to the high-melting point oxide ($M^HO$) is insufficient, and hence it is difficult to disperse the high-melting point oxide ($M^HO$) in the core material. Further, because the high-melting point oxide ($M^HO$) hardly gathers to the particle boundaries, insulating properties are lowered. If the ratio is higher than the upper limit of the above range, the amount of the high-melting point oxide ($M^HO$) is relatively small, and hence insulating properties of the particle boundary phase are lowered.

Although the total amount [($M^LO$)+($M^HO$)] by weight of the low-melting point oxide ($M^LO$) and the high-melting point oxide ($M^HO$) may be an extremely trace amount, it is controlled to be preferably more than 0% by weight and less than 24% by weight, more preferably 0.02 to 20% by weight, particularly preferably 0.04 to 3% by weight, based on 100% by weight of the carrier core material. If the total amount is lower than the lower limit of the above range, the effect by the addition of these components is not exhibited, and particularly, the effect of inhibiting leakage of electric charge is not exhibited. If the total amount is higher than the upper limit of the above range, the composition of the ferrite for forming the carrier core material is disordered, and the magnetization of the carrier core material becomes too low.

The carrier core material has a volume average particle diameter of usually 15 to 70 μm, preferably 20 to 50 μm. In the carrier core material, the content of fine particles having a particle diameter of less than 10 μm is usually not more than 3% by weight, preferably not more than 1% by weight, and the content of coarse particles having a particle diameter of more than 90 μm is usually not more than 3% by weight, preferably not more than 1% by weight.

The carrier core material of the invention has a BET specific surface area of usually 200 to 2000 $m^2/g$, preferably. 300 to 1800 $m^2/g$.

The ferrite carrier core material has an electrical resistivity of usually not less than $10^2$ Ω·cm, preferably $10^3$ to $10^{12}$ Ω·cm, more preferably $10^4$ to $10^{11}$ Ω·cm.

Figure 2:
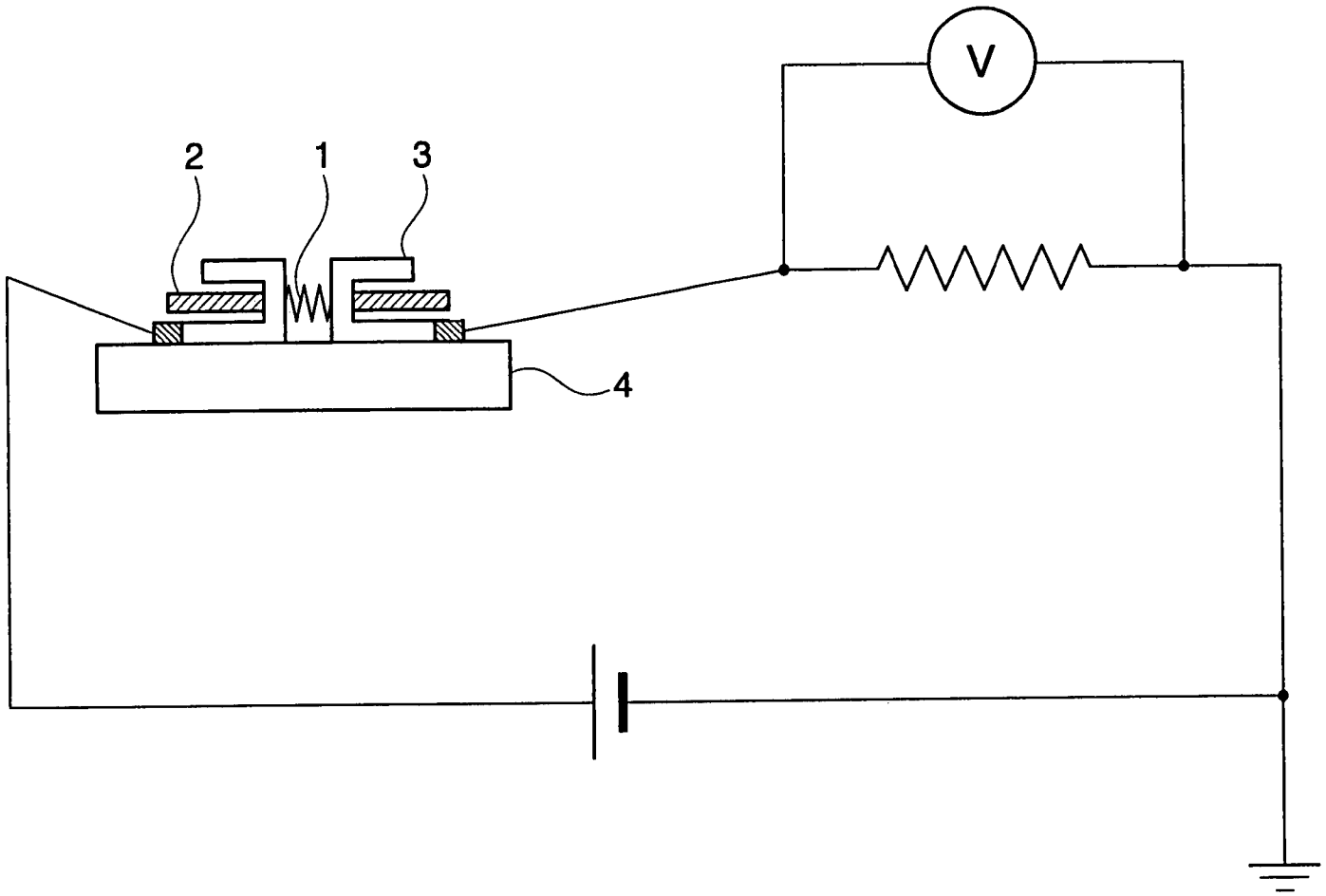
FIG. 2 is an explanatory view showing an electrical resistance measuring machine used in the present invention.

The electrical resistance of the carrier core material and the coated carrier can be measured by the use of, for example, such an electrical resistance measuring machine as shown in FIG. 2. Referring to FIG. 2, numeral 1 designates a sample (carrier core material, coated carrier), numeral 2 designates a magnetic pole, numeral 3 designates an electrode (brass plate), and numeral 4 designates an insulating material (fluororesin plate).

As shown in FIG. 2, N pole and S pole are allowed to face each other at a magnetic pole distance of 2.0 mm, and 200 mg of a sample is weighed and filled between non-magnetic parallel flat plate electrodes (area: 10×40 mm). The magnetic poles (surface magnetic flux density: 1500 gauss, area of facing electrodes: 10×30 mm) are fitted to the parallel flat plate electrodes to hold the sample between the electrodes. Then, electrical resistance of the carrier at an applied voltage of 1000 V is measured using an insulation electrical resistance meter or an ammeter. The electrical resistivity is calculated from the following formula.

$$\text{Electrical resistivity } (\Omega\cdot\text{cm}) = \text{Resistance value } (\Omega\text{: measured value}) \times \text{Electrode contact area } (\text{cm}^2) \text{ of measuring sample/Electrode distance (cm)}$$

From the above formula, an electrical resistivity in a high electric field of 20000 V/cm can be calculated.

The carrier core material can be used as it is to form a coated carrier, or the surface of the carrier core material may be subjected to oxide coating treatment. When the structure of the carrier core material having been subjected to the oxide coating treatment is examined by X-ray diffractometry, it can be confirmed that, by virtue of the oxide coating treatment, a layer having a high concentration of $Fe_2O_3$ other than a spinel structure is formed in a thickness of several μm from the outermost surface of the ferrite carrier core material toward the center. By the formation of such a layer, dielectric breakdown of the carrier core material does not occur even when a high voltage is applied, and leakage of electric charge can be inhibited. It is preferable that the layer (oxide coating layer) having a high concentration of $Fe_2O_3$ is formed in a thickness (depth) of not less than 50 nm from the surface of the ferrite carrier core material, and the depth is particularly preferably in the range of 0.1 to 3 μm. The depth of the layer having a high concentration of $Fe_2O_3$ preferably reaches 1/1000 to 1/5 of the particle diameter from the particle surface.

The ferrite core material wherein the particle surface has been subjected to oxide coating has an electrical resistivity of usually not less than $10^3$ Ω·cm, preferably $10^4$ to $10^{13}$ Ω·cm, more preferably $10^5$ to $10^{12}$ Ω·cm.

The carrier core material of the invention has excellent magnetic properties, and the magnetic properties of the carrier core material can be measured by the use of an integration type B-H tracer (BHU-60 type, manufactured by Riken Denshi Co., Ltd.). This device is filled with about 1 g of a sample to form a magnetic hysteresis loop of the carrier core material, and from the hysteresis loop, magnetization (Ms), residual magnetization (Mr) and coercive force (Hc) can be calculated.

The magnetization (Ms) of the carrier core material of the invention at 1000 ($10^3/4\pi\cdot$A/m) (1000 oersted), as measured in the above-mentioned manner, is in the range of usually 40 to 100 $Am^2/kg$ (40 to 100 emu/g), preferably 50 to 95 $Am^2/kg$ (50 to 95 emu/g), more preferably 65 to 95 $Am^2/kg$ (65 to 95 emu/g). The residual magnetization (Mr) of the carrier core material at 1000($10^3/4\pi\cdot$A/m) (1000 oersted) is usually not more than 20 $Am^2/kg$ (20 emu/g), preferably not more than 15 $Am^2/kg$ (15 emu/g), particularly preferably not more than 5 $Am^2/kg$ (5 emu/g) The coercive force (Hc) of the carrier core material is usually not more than 50 ($10^3/4\pi\cdot$A/m) (50 oersted), preferably not more than 30 ($10^3/4\pi\cdot$A/m) (30 oersted), particularly preferably not more than 15 ($10^3/4\pi\cdot$A/m) (15 oersted). If the magnetization is lower than the lower limit of the above range, carrier adhesion is liable to take place. If the magnetization is higher than the upper limit of the above range, a head of a magnetic brush formed becomes hard. As a result, brush streaks are liable to be produced, and it becomes difficult to form an image of high quality. If the residual magnetization or the coercive force is too high, the developing agent has poor fluidity, and rise of frictional charging between the coated carrier and the toner becomes bad to easily bring about a phenomenon of toner fly or fog.

It is preferable that the carrier core material of the invention does not have heat history of being heated to a temperature higher than the melting point of the high-melting point oxide ($M^HO$). That is to say, in the carrier core material of the invention, a part of the high-melting point oxide ($M^HO$) is preferably independently present in the dispersed state without forming a solid solution with another component, and in order to disperse the high-melting point oxide ($M^HO$) independently from another component, the maximum heating temperature in the preparation process of the carrier core material is desirably controlled to be not higher than the melting point of the high-melting point oxide ($M^HO$), preferably lower than the melting point. By controlling the heating temperature in this manner, a coated carrier formed from the carrier core material of the invention is free from leakage of electric charge even in a high electric field, and besides, magnetization and electrical resistivity can be each independently controlled to be in the preferred range.

The electrophotographic carrier (coated carrier) of the invention usually comprises the above-described carrier core material composed of the ferrite component and a resin coat formed on the surface of the carrier core material.

In the electrophotographic carrier of the invention, a resin coat is formed on the surface of the carrier core material composed of the ferrite component. As the coating resin for forming the resin coat, any of various resins heretofore known is employable. Examples of such coating resins include fluororesin, acrylic resin, epoxy resin, polyester resin, fluorine-acrylic resin, fluorine-epoxy resin, acrylic-styrene resin, silicone resin, and modified silicone resin modified with acrylic resin, polyester resin, epoxy resin, alkyd resin, urethane resin, fluororesin or the like.

The resin is used in an amount of usually 0.01 to 10.0% by weight, preferably 0.3 to 7.0% by weight, more preferably 0.5 to 3.0% by weight, based on the carrier core material. If the coating amount is less than 0.01% by weight, it is difficult to form a uniform coating layer on the surface of the carrier core material. If the coating amount exceeds 10.0% by weight, aggregation of carrier particles is liable to take place to cause lowering of productivity, such as poor yield, or to cause change of properties of the developing agent, such as fluidity in the developing apparatus or quantity of electrostatic charge.

Since the resin coat formed on the carrier core material receives heavy stress by stirring of a toner or collision with a doctor blade in the developing apparatus, the resin coat is liable to peel off or is markedly abraded. As a result, a spent phenomenon that toner particles are adhered to the surface of carrier particle is liable to occur in the development box.

Accordingly, the resin used for coating the carrier core material is preferably a resin capable of keeping stable properties of the developing agent for a long period of time and hardly influenced by the severe conditions in the developing apparatus. As the resin having such properties, a resin having a structure represented by the following formula (I) and/or (II) is particularly preferably employed. By the use of a resin having such a structure, the coated carrier not only has excellent abrasion resistance, peel resistance and spent resistance but also tends to be water-repellent.

(I)

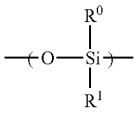

(II)

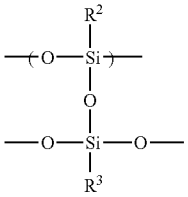

In the formulas (I) and (II), $R^0$, $R^1$, $R^2$ and $R^3$ are each independently a hydrogen atom, a halogen atom, a hydroxyl group, a methoxy group, an alkyl group of 1 to 4 carbon atoms or a phenyl group.

The resin having a structure represented by the formula (I) or (II) is, for example, a straight silicone resin, and this resin may be modified with another organic group. Examples of the modified resins include an acrylic-modified silicone resin, an epoxy-modified silicone resin and a fluorine-modified silicone resin. These resins can be used singly or in combination. In the use of these resins in combination, polarity given by these resins to the carrier should be taken into consideration.

In order to enhance adhesion properties of the resin, a crosslinking agent of oxime type or the like can be added.

In the resin for coating the carrier core material, a silane coupling agent is preferably contained as a charging controlling agent. When a resin coat is formed in such a manner that the exposed area of the core material becomes relatively small, the charging ability of the electrophotographic coated carrier is sometimes lowered, and in this case, use of the silane coupling agent makes it possible to control the charging ability of the electrophotographic coated carrier. The type of the silane coupling agent used for controlling the charging ability is not specifically restricted, but for a coated carrier used when a negative-polarity toner is used, an aminosilane coupling agent is preferably used, and for a coated carrier used when a positive-polarity toner is used, a fluorosilane coupling agent is preferably used. The silane coupling agent is used in an amount of usually 0.01 to 100 parts by weight, preferably 0.1 to 50 parts by weight, based on 100 parts by weight of the resin used as the coating agent.

In the present invention, conductive fine particles can be added to the coating resin of the coated carrier to control electrical resistivity of the coated carrier. In the electrophotographic coated carrier of the invention, if the coating amount of the resin is too large, the electrical resistivity of the coated carrier is sometimes increased excessively, and in this case, the developing power of the developing agent is occasionally, lowered. In such a case, the electrical resistivity of the coated carrier can be controlled by adding a small amount of conductive fine particles to the coating resin of the coated carrier. The conductive fine particles, however, have high electrical conductivity, and their electrical resistivity is lower than that of the coating resin or the core material, so that if the amount of the conductive fine particles added is to large, leakage of electric charge from the coated carrier attributable to the conductive fine particles sometimes occur. Therefore, the amount of the conductive fine particles added is in the range of usually 0.25 to 20.0% by weight, preferably 0.5 to 15.0% by weight, particularly preferably 1.0 to 10.0% by weight, based on the solid content of the coating resin.

Examples of the conductive fine particles employable in the invention include conductive carbon and oxides such as titanium oxide and tin oxide. These can be used singly or in combination.

The magnetic properties of the coated carrier of the invention can be measured in the same manner as in the measurement of magnetic properties of the carrier core material. The magnetization (Ms) of the coated carrier of the invention at $1000(10^3/4\pi\cdot A/m)$ (1000 oersted) is in the range of usually 40 to 100 $Am^2/kg$ (40 to 100 emu/g), preferably 50 to 95 $Am^2/kg$ (50 to 95 emu/g), more preferably 65 to 95 $Am^2/kg$ (65 to 95 emu/g).

If the magnetization (Ms) of the coated carrier of the invention as measured in the aforesaid manner is less than 40 $Am^2/kg$ (40 emu/g), carrier adhesion is liable to take place though reproducibility of halftone or gradation becomes relatively good. If the magnetization exceeds 100 $Am^2/kg$ (100 emu/g), a head of a magnetic brush becomes hard, and hence image defects such as brush streaks are easily produced. Moreover, excellent gradation or resolution is unobtainable, and an image of high quality cannot be obtained.

The residual magnetization (Mr) of the coated carrier of the invention at $1000(10^3/4\pi\cdot A/m)$ (1000 oersted) is usually not more than 20 $Am^2/kg$ (20 emu/g), preferably not more than 15 $Am^2/kg$ (15 emu/g), particularly preferably not more than 5 $Am^2/kg$ (5 emu/g). The coercive force (Hc) of the coated carrier is usually not more than $50(10^3/4\pi \cdot A/m)$ (50 oersted), preferably not more than 30 $(10^3/4\pi \cdot A/m)$ (30 oersted), particularly preferably not more than $5(10^3/4\pi \cdot A/m)$ (15 oersted). If the residual magnetization or the coercive force is too high, the developing agent has poor fluidity, and rise of frictional charging between the coated carrier and the toner becomes bad to easily bring about a phenomenon of toner fly or fog.

The coated carrier of the invention has an electrical resistivity of not less than $10^7$ Ω·cm, preferably $10^7$ to $10^{14}$ Ω·cm, particularly preferably $10^8$ to $10^{13}$ Ω·cm.

The coated carrier has an average particle diameter of usually 15 to 70 μm, preferably 20 to. 50 μm. The coated carrier has a 635-mesh passing ratio of usually not more than 10% by weight. The 635-mesh passing ratio of the coated carrier is preferably not more than 3% by weight, particularly preferably not more than 1% by weight.

If the average particle diameter of the coated carrier of the invention exceeds 70 μm, unevenness of solid or nonuniformity of halftone tends to occur, and it becomes difficult to obtain high image quality. If the average particle diameter is less than 15 μm carrier adhesion is liable to take place. By uniformalizing the particle diameters so that the 635-mesh passing ratio of the coated carrier of the invention should not exceed 10% by weight, adhesion of the coated carrier to the photosensitive member can be prevented, and image defects due to white spots liable to be produced particularly in case of a full color image can be effectively prevented.

In the present invention, the average particle diameters of the carrier core material and the coated carrier are values measured by the use of a MICROTRAC particle size analyzer (Model 9320-X100) manufactured by Nikkiso K.K. The 635-mesh passing ratio is measured by a q/m meter manufactured by EPPING GmBH using a 635-mesh wire cloth. That is to say, 2 $cm^3$ of a coated carrier is filled in a measuring cell using a 635-mesh wire cloth and is sucked for 90 seconds at a suction pressure of 1050±5 mbar to determine a loss in weight after the suction, and the loss in weight is taken as a 635-mesh passing ratio.

The electrophotographic carrier of the invention can be prepared by mixing the high-melting point oxide ($M^HO$), the low-melting point oxide ($M^LO$), $Fe_2O_3$, and preferably, a metal compound capable of forming a metal oxide (MO) in the aforesaid amounts in terms of an oxide, and then calcining the mixture.

As a source of $Fe_2O_3$, not only iron oxide but also a substance obtained by roasting an acid cleaning liquid of steel or a substance obtained by roasting natural magnetite is employable.

The above-mentioned starting material components are weighed, pulverized and mixed. The pulverization and mixing may be carried out by a wet process or a dry process. In case of a wet process, a wet ball mill, a wet oscillating mill or the like is employable. The pulverization time in the pulverization mixing process is usually not shorter than 1 hour, preferably 1 to 20 hours.

The resulting pulverizate is dried and then temporarily calcined by a rotary kiln or the like.

The temporary calcining is carried out by heating the pulverizate at a temperature lower than the melting point of the high-melting point oxide ($M^HO$) used. Specifically, the temporary calcining is carried out by maintaining the pulverizate at a temperature of usually. 700 to 1200° C., preferably 800 to 1000° C., for usually 0.1 to 5 hours, preferably 0.5 to 3 hours. By the temporary calcining, the apparent density of the resulting carrier can be increased. Therefore, when an electrographic carrier having a low apparent density is to be obtained, this temporary calcining can be omitted.

After the temporary calcining, the temporarily calcined product is pulverized again. This pulverization is preferably carried out by a wet process, and usually, the temporarily calcined product is dispersed in water and pulverized again. For the pulverization, a wet ball mill, a wet oscillating mill or the like is employable. The pulverization is carried out in such a manner that the resulting pulverizate has a particle diameter (average value) of usually not more than 15 μm, preferably not more than 5 μm particularly preferably not more than 3 μm, most preferably not more than 2 μm. In the wet pulverization process using a wet ball mill, a wet oscillating mill or the like, the pulverization time is in the range of usually 0.5 to 20 hours, preferably 1 to 10 hours.

After the pulverization, a dispersant, a binder, etc. are added when needed. Then, by the use of a drying-granulating apparatus, such as a spray drier, removal of water content, drying and control of particle size are carried out.

In the present invention, the resulting granulate is then calcined. The calcining is carried out by heating the granulate at a temperature lower than the melting point of the high-melting point oxide ($M^HO$) used. That is to say, the granulate is maintained at a temperature of usually 1000 to 1500° C., preferably 1100 to 1350° C. Under such calcining conditions, calcining is carried out for a period of usually 1 to 24 hours, preferably 2 to 10 hours.

The oxygen concentration in the calcining process exerts an influence on the oxidized state of the surface of the resulting ferrite carrier, so that in the calcining process, the oxygen concentration in the calcining apparatus is controlled to be in a given range. In the present invention, the oxygen concentration in the calcining apparatus is desirably controlled to be usually not more than 5% by volume, preferably 0 to 3% by volume, particularly preferably 0.1 to 1% by volume.

Although the carrier core material obtained as above can be coated as such with a resin, the carrier core material is heated in the atmosphere to perform oxide coating treatment and thereby control electrical resistivity. The oxide coating treatment is carried out at a temperature lower than the melting point of the high-melting point oxide ($M^HO$) used. For example, the oxide coating treatment is carried out by heating the carrier core material in the atmosphere at a temperature of usually 300 to 700° C., preferably 450 to 650° C., using a conventional rotary electric oven, a batch type electric oven or the like. If the temperature is lower than 300° C., the effect by the oxide coating treatment is not exhibited markedly. If the temperature is higher than 700° C., magnetization is lowered.

By treating the carrier core material under the above conditions for 1 to 180 minutes, preferably 10 to 120 minutes, the electrical resistivity of the carrier core material is further increased. Prior to the oxide coating treatment, the carrier core material of the invention may be subjected to reduction treatment at a temperature of not higher than 250° C., when needed.

The calcined product obtained as above is then crushed and classified. Examples of the classification methods include air classification, sieve filtration and sedimentation. The particle diameter of the carrier core material is preferably controlled to be in the desired range by these classification methods.

In order to remove particles of low magnetization, it is preferable to carry out magnetic separation before or after the classification.

The carrier core material prepared as above is then coated with a resin, whereby a coated carrier is prepared. Examples of the coating resins employable herein include the aforesaid resins.

For coating the carrier core material with the coating resin, publicly known methods, such as a brushing method, a dry method, a spray drying method using a fluidized bed, a rotary drying method and a liquid immersion drying method using a universal stirrer, are employable. In order to increase a coating ratio, the method using fluidized bed is preferable.

When the carrier core material is subjected to baking after the resin coating, the baking may be carried out by an external heating method or an internal heating method. For example, a fixed or fluid electric oven, a rotary electric oven or a burner oven is employable, or microwave may be used for the baking without using such, ovens.

The baking temperature is lower than the melting point of the high-melting point oxide ($M^HO$) and varies depending upon the type of the resin used, but it is necessary to heat the carrier at a temperature of not lower than the melting point or the glass transition temperature of the resin used. When a thermosetting resin or a condensation crosslinking type resin is used, the heating temperature is preferably maintained until the resin is sufficiently cured. After the coating layer is formed, the coated carrier is crushed and classified, when needed. As the classification method, air classification, mesh filtration, sedimentation or the like is employable.

The two-component developing agent of the present invention comprises the above-described coated carrier and toner particles. The toner particles for use in the invention include ground toner particles prepared by grinding and polymerized toner particles prepared by polymerization. In the present invention, toner particles obtained by any of those processes are employable.

The ground toner particles can be obtained by, for example, a process comprising sufficiently mixing a binding resin, a charging controlling agent and a colorant by a mixing machine such as a Henschel mixer, melt kneading the mixture by a twin-screw extruder or the like, then cooling, grinding, classifying, adding external additives and mixing them by a mixer or the like.

The binding resin for forming the toner particles is not specifically restricted, but there can be mentioned, for example, polystyrene, chloropolystyrene, a styrene/chlorostyrene copolymer, a styrene/acrylic acid ester copolymer, a styrene/methacrylic acid copolymer, a rosin-modified maleic acid resin, an epoxy resin, a polyester resin and a polyurethane resin. These resins are used singly or in combination.

As the charging controlling agent, an arbitrary agent is employable. Examples of the charging controlling agents for positive charge toner include nigrosine type dyes and quaternary ammonium salts. Examples of the charging controlling agents for negative charge toner include metal-containing monoazo dyes.

As the colorant (coloring material), a dye and/or a pigment heretofore known is employable. Examples of such colorants include carbon black, phthalocyanine blue, permanent red, chrome yellow and phthalocyanine green. In addition to the above components, external additives, such as a silica powder and titania, can be added to the toner particles in order to improve fluidity and aggregation resistance of the toner.

The polymerized toner particles are toner particles prepared by a known process, such as suspension polymerization or emulsion polymerization. The polymerized toner particles can be obtained by, for example, a process comprising mixing and stirring a colorant dispersion wherein a colorant is dispersed in water using a surface active agent., a polymerizable monomer, a surface active agent and a polymerization initiator in an aqueous medium to emulsify the polymerizable monomer in the aqueous medium, then further stirring and mixing the emulsion to perform polymerization, and adding, for example, a salting-out agent to salt out polymer particles, followed by filtering, washing and drying the resulting particles. Thereafter, external additives are added to the dried toner particles, when needed.

In the preparation of the polymerized toner, particles, a fixing property improver and a charging controlling agent can be added in addition to the polymerizable monomer, the surface active agent, the polymerization initiator and the colorant, whereby various properties of the resulting polymerized toner particles can be controlled or improved. Moreover, a chain transfer agent can be used to improve dispersibility of the polymerizable monomer in the aqueous medium and to control molecular weight of the resulting polymer.

The polymerizable monomer used for preparing the polymerized toner particles is not specifically restricted, but there can be mentioned, for example, styrene and its derivatives; ethylenically unsaturated monoolefins, such as ethylene and propylene; halogenated vinyls, such as vinyl chloride; vinyl esters, such as vinyl acetate; and α-methylene aliphatic monocarboxylic acid esters, such as methyl acrylate, ethyl acrylate, methyl methacrylate, ethyl methacrylate, 2-ethylhexyl methacrylate, dimethyl aminoacrylate and diethyl aminomethacrylate.

As the colorant (coloring material) used for preparing the polymerized toner particles, a dye or a pigment heretofore known is employable. Examples of such colorants include carbon black, phthalocyanine blue, permanent red, chrome yellow and phthalocyanine green. The surface of the colorant may be modified with a surface modifier such as a silane coupling agent or a titanium coupling agent.

As the surface active agent used for preparing the polymerized toner particles, an anionic surface active agent, a cationic surface active agent, an amphoteric surface active agent or a nonionic surface active agent is employable.

Examples of the anionic surface active agents include fatty acid salts, such as sodium oleate and castor oil; alkylsulfuric acid esters, such as sodium laurylsulfate and ammonium laurylsulfate; alkylbenzenesulfonic acid salts, such as sodium dodecylbenzenesulfonate; alkylnaphthalenesulfonic acid salts; alkylphosphoric acid ester salts; naphthalenesulfonic acid formalin condensate; and polyoxyethylene alkylsulfuric acid ester salts.

Examples of the nonionic surface active agents include polyoxyethylene alkyl ethers, polyoxyethylene fatty acid esters, sorbitan fatty acid esters, polyoxyethylene alkylamine, glycerol, fatty acid esters, and a oxyethylene/oxypropylene block polymer.

Examples of the cationic surface active-agents include alkylamine salts, such as laurylamine acetate; and quaternary ammonium salts, such as lauryltrimethylammonium chloride and stearyltrimethylammonium chloride.

Examples of the amphoteric surface active agents include aminocarboxylic acid salts and alkylamino acids.

The surface active agent is used in an amount of usually 0.01 to 10% by weight based on the polymerizable monomer. The amount of the surface active agent exerts an influence not only on the dispersion stability of the monomer but also on the environmental dependence of the resulting polymerized toner particles. Therefore, it is preferable to use the surface active agent in such an amount that the dispersion stability of the monomer is ensured and the surface active agent does not exert an excess influence on the environmental dependence of the polymerized toner particles.

In the preparation of the polymerized toner particles, a polymerization initiator is usually used. The polymerization initiator includes a water-soluble polymerization initiator and an oil-soluble polymerization initiator, and in the present invention, any of them is employable. Examples of the water-soluble polymerization initiators employable in the invention include persulfuric acid salts, such as potassium persulfate and ammonium persulfate, and water-soluble peroxide compounds. Examples of the oil-soluble polymerization initiators include azo compounds, such as azobisisobutyronitrile, and oil-soluble peroxide compounds.

When the chain transfer agent is used in the invention, there can be mentioned, as examples thereof, mercaptans, such as octylmercaptan, dodecylmercaptan and tert-dodecylmercaptan, and carbon tetrabromide.

When the polymerized toner particles used in the invention contains a fixing property improver, there can be mentioned, as examples of the fixing property improvers, natural waxes, such as carnauba wax, and olefin waxes, such as polypropylene and polyethylene When the polymerized toner particles used in the invention contains a charging controlling agent, the type of the charging controlling agent is not specifically restricted, and examples thereof include nigrosine type dyes, quaternary ammonium salts, organometallic complexes and metal-containing monoazo dyes.

Examples of the external additives used for improving fluidity of the polymerized toner particles include silica, titanium oxide, barium titanate, fluorine fine particles and acrylic fine particles. These external additives can be used singly or in combination.

Examples of the salting-out agents used for separating the polymer particles from the aqueous medium in the preparation of the polymerized toner particles include metal salts, such as magnesium sulfate, aluminum sulfate, barium chloride, magnesium chloride, calcium chloride and sodium chloride.

The average particle diameter of the toner particles prepared as above is in the range of 3 to 15 μm, preferably 5 to 10 μm. The polymerized toner particles have higher particle uniformity than the ground toner particles. If the average particle diameter of the toner particles is less than 3 μm, charging ability is lowered, and fog or toner fly is liable to occur. If the average particle diameter of the toner particles exceeds 15 μm, image quality may be deteriorated.

The coated carrier and the toner particles prepared above are mixed, whereby the developing agent for electrophotography of the invention can be obtained. The content of the toner particles in the developing agent, namely, toner concentration, is preferably in the range of 5 to 15%. If the toner concentration is less than 5%, it is difficult to obtain a desired image density. If the toner concentration exceeds 15%, toner fly or fog is liable to occur.

The two-component developing agent prepared as above can be used in an electrophotographic apparatus (copy machine, printer, Fax, printing machine, etc.) of a development system wherein a latent image formed on a photosensitive member having an organic photoconductive layer is reversely developed. This developing agent is particularly suitable for an image forming method wherein a latent image is developed with the toner particles with applying a bias electric field having an alternating current component and a direct current component to the developing portion in the developing region of a magnetic brush that faces the photosensitive member for holding the latent image.

The two-component developing agent of the invention can be used in the above-mentioned developing system. The two-component developing agent of the invention is particularly favorable as a developing agent for a full color machine and the like using the aforesaid alternating electric field.

The carrier core material and the coated carrier of the present invention contain a high-melting point oxide ($M^HO$) and a low-melting point oxide ($M^LO$), and the metal ($M^H$) for constituting the metal oxide ($M^HO$) has an electrical resistivity of not less than $10^{-5}$ Ω·cm. In the carrier core material, it is preferable that at least a part of the metal oxide is dispersed in ferrite of prescribed composition without forming a solid solution. The ferrite core material and the coated carrier exhibit such excellent electrical properties that they have high magnetization and are free from leakage of electric charge over a wide range of electric field from low electric field to high electric field.

The two-component developing agent of the present invention comprises the coated carrier and toner particles. By the use of the two-component, developing agent, an excellent image can be formed even in a developing system using an alternating electric field.

EXAMPLES

The present invention is further described with reference to the following examples, but it should be construed that the invention is in no way limited to those examples.

Example 1

MnO of 470% by mol, MgO of 3% by mol and $Fe_2O_3$ of 50% by mol were weighed, and based on 100 parts by weight of the total of these metal oxides, 3 parts by weight of $Bi_2O_3$ (melting point: 824° C.) and 3 parts by weight of $ZrO_2$ (melting point: 2715° C.) were weighed and added.

According to "Metal Data Book" (edited by The Japan Institute of Metals), Mn has an electrical resistivity of $1.60\times10^{-4}$ Ω·cm, Mg has an electrical resistivity of $3.9\times10^{-6}$ Ω·cm, Bi has an electrical resistivity of $1.16\times10^{-4}$ Ω·cm, and Zr has an electrical resistivity of $4.46\times10^{-5}$ Ω·cm.

The mixture was blended and pulverized by a wet ball mill for 5 hours and then maintained at 950° C. for 1 hour in a rotary kiln to perform temporary calcining.

The temporarily calcined product was pulverized by a wet ball mill for 7 hours to obtain particles having an average particle diameter of 1.5 μm.

To the resulting slurry, a dispersant and a binder were added in proper amounts. Then, the mixture was granulated and dried by a spray drier. Thereafter, the granulate was held in an electric furnace for 6 hours under the conditions of a temperature of 1250° C. and an oxygen concentration of 0.3% to perform calcining.

The calcined product was crushed and then classified to control particle size, whereby a carrier core material was obtained. The average particle diameter of the carrier core material was 42.1 μm.

The weight ratio ($(M^LO)/(M^HO)$) of the low-melting point oxide ($M^LO$) to the high-melting point oxide ($M^HO$) contained in the carrier core material obtained above was 1.00, and the total content ($(M^LO)+(M^HO)$) by weight of the low-melting point oxide ($M^LO$) and the high-melting point oxide ($M^HO$) in the carrier core material was 6% by weight. The carrier core material obtained above was analyzed by X-ray diffractometry, and as a result, at least a part of the high-melting point oxide ($M^HO$) was contained in the form of fine particles in the carrier core material without forming a solid solution with the formed ferrite component. Further, the concentration of the high-melting point oxide ($M^HO$) was measured by fluorescent X-ray quantitative analysis with changing X-ray generating voltage, and as a result, the high-melting point oxide ($M^HO$) was contained inside the core material particle in a concentration higher than that in the vicinity of the surface thereof.

Separately, the coating resin was prepared in the following manner. 100 Parts by weight of chlorosilane (mixture of 9 mol of $CH_3SiCl_3$ and 1 mol of $(CH_3)_2SiCl_2$) were dropwise added to a mixture of 300 parts by weight of water, 500 parts by weight of toluene and 100 parts by weight of lower alcohol (butanol/propyl alcohol mixed liquid), and they were mixed. Then, the mixture was subjected to liquid separation, and the aqueous layer was removed. Then, the low-boiling point component was further removed to obtain a 20% silicone resin of the following formulas (I) and (II). Based on 100 parts by weight of the solid content of the silicone resin, 20 parts by weight of a compound represented by the following formula (III), 3 parts by weight of a compound represented by the following formula (IV) and 10 parts by weight of a compound represented by the following formula (V) were added to the silicone resin, and they were sufficiently stirred and mixed to prepare a coating silicone resin. The coating silicone resin was diluted with toluene to obtain a 10% solution as a coating solution.

(I)

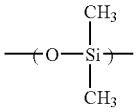

(II)

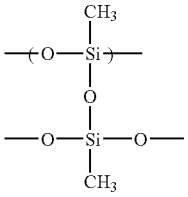

(III)

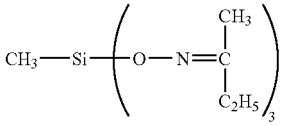

(IV)

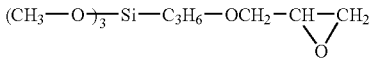

$$NH_2—C_3H_6—Si(O—C_2H_5)_3 \quad (V)$$

Then, the carrier core material comprising ferrite particles was coated with the silicone resin solution by the use of a fluidized bed until the coating amount in terms of a solid became 1.5 parts by weight based on 100 parts by weight of the carrier core material, then dried and baked at 250° C. for 3 hours to prepare a coated carrier (carrier 1).

The coated carrier thus obtained was mixed with commercially available toners (for CF-70, available from Minolta K.K., magenta, cyan, yellow black) to prepare two-component developing agents each having a toner concentration of 10% by weight. The average particle diameter of each toner was 9.8 μm. The resin component for forming each toner was a polyester resin and contained a salicylic acid-Zn complex as a charging controlling agent.

Composition of the carrier core material is set forth in Table 1. Magnetic properties of the carrier core material, electrical resistivity thereof in each step, and average particle diameter, 635-mesh passing ratio, electrical resistivity and magnetic properties of the coated carrier are set forth in Table 2. After the printing impression test using the two-component developing agents prepared by the use of the coated carrier, image evaluation (solid uniformity, halftone uniformity, gradation, resolution, carrier adhesion (white spot)) was carried out, and based on the image evaluation, overall evaluation of the two-component developing agents was carried out. The results are set forth in Table 3.

Magnetic Properties of Carrier Core Material and Coated Carrier

Magnetic properties of the carrier core material and the coated carrier were measured in the following manner using an integration type B-H tracer (BHU-60 type, manufactured by Riken Denshi Co., Ltd.).

First, a magnetic field was applied to the measuring sample, and the magnetic field was swept to 3000($10^3/4\pi \cdot A/m$) (3000 oersted). Then, the applied magnetic field was reduced to form a hysteresis loop, and from the hysteresis loop, magnetization (Ms), residual magnetization (Mr) and coercive force (Hc) at 1000($10^3/4\pi \cdot A/m$) (1000 oersted) were calculated.

Measurement of Electrical Resistivity of Carrier Core Material and Coated Carrier Electrical resistivity of the carrier core material and the coated carrier was measured by the use of such an electrical resistance measuring machine as shown in FIG. 2. Referring to FIG. 2, numeral 1 designates a sample (carrier core material, coated carrier), numeral 2 designates a magnetic pole, numeral 3 designates an electrode (brass plate), and numeral 4 designates an insulating material (fluororesin plate).

As shown in FIG. 2, N pole and S pole were allowed to face each other at a magnetic pole distance of 2.0 mm, and 200 mg of a sample was weighed and filled between non-magnetic parallel flat plate electrodes (area: 10×40 mm). The magnetic poles (surface magnetic flux density: 1500 gauss, area of facing electrodes: 10×30 mm) were fitted to the parallel flat plate electrodes to hold the sample between the electrodes. Then, electrical resistance of the carrier at an applied voltage of 1000 V was measured by the use of an insulation electrical resistance meter or an ammeter. The electrical resistivity was calculated from the following formula.

$$\text{Electrical resistivity } (\Omega \cdot \text{cm}) = \text{Resistance value } (\Omega\text{: measured value}) \times \text{Electrode contact area } (\text{cm}^2) \text{ of measuring sample/Electrode distance (cm)}$$

From the above formula, an electrical resistivity in a high electric field of 20000 V/cm can be calculated.

Average Particle Diameter of Carrier

An average particle diameter of the carrier was measured by the use of a MICROTRAC particle size analyzer (Model 9320-X100) manufactured by Nikkiso K.K.

Printing Evaluation

The two-component developing agents obtained were subjected to a printing impression test of 30000 sheets (sometimes referred to as 30 K by representing 1000 sheets by 1 K) using a commercially available apparatus (CF-70, manufactured by Minolta K.K.). Image evaluation (solid uniformity, halftone uniformity, gradation, resolution, carrier adhesion (white spot)) after the printing impression test and overall evaluation of the two-component developing agents based on the image evaluation are set forth in Table 3. Each item was evaluated and ranked, and the ranks are shown in Table 3. A rank of CC or higher is a level of no problem in practical use. The evaluation methods are as follows.

Solid Uniformity

Development was carried out under proper exposure conditions, and uniformity of the solid portion was evaluated and ranked by visual observation.

AA: The solid portion is extremely uniform.

BB: The solid portion is uniform and has no unevenness.

CC: The solid portion has somewhat unevenness but is on a serviceable level.

DD: The solid portion has appreciable unevenness and is nonuniform.

EE: The solid-portion has marked unevenness and is nonuniform.

Halftone Uniformity

Development was carried out under proper exposure conditions, and uniformity of the halftone portion was evaluated and ranked by visual observation.

AA: The halftone portion is extremely uniform.

BB: The halftone portion is uniform and has no unevenness.

CC: The halftone portion has somewhat unevenness but is on a serviceable level.

DD: The halftone portion has appreciable unevenness and is nonuniform.

EE: The halftone portion has marked unevenness and is nonuniform.

Gradation

Development was carried out under proper exposure conditions, and gradation was observed and ranked.

AA: The gradation is extremely good.

BB: The gradation is good.

CC: The gradation is on a serviceable level.

DD: The gradation is bad.

EE: The gradation is extremely bad.

Resolution

Development was carried out under proper exposure conditions, and resolution was observed and ranked.

AA: The resolution is extremely good.

BB: The resolution is good.

CC: The resolution is on a serviceable level.

DD: The resolution is bad.

EE: The resolution is extremely bad.

Carrier Fly

Carrier adhesion and white spots on an image were evaluated.

AA: There is no white spot in 10 sheets of paper of A3 size.

BB: There are 1 to 5 white spots in 10 sheets of paper of A3 size.

CC: There are 6 to 10 white spots in 10 sheets of paper of A3 size.

DD: There are 11 to 20 white spots in 10 sheets of paper of A3 size.

EE: There are 21 or more white spots in 10 sheets of paper of A3 size.

Overall Evaluation

The overall evaluation of the two-component developing agents was carried out based on the image evaluation after the 30 K printing impression test and the printing impression test, and the developing agents were ranked based on the overall evaluation.

AA: Throughout the 30 K printing impression test, an extremely good image is maintained without any change from the initial stage.

BB: Throughout the 30 K printing impression test, there is a little change in each item as compared with the initial stage, but the developing agent is on a good level without any problem in practical use.

CC: Throughout the 30 K printing impression test, there is a change in each item, but the developing agent has no problem in practical use.

DD: Throughout the 30 K printing impression test, there is a great change in each item, and the developing agent is practically unemployable.

EE: From the initial stage of the test, there are some items practically unemployable, or changes in some items are so great that the printing impression of 30 K cannot be achieved.

Examples 2 and 3, Comparative Examples 1 to 4

A carrier core material was prepared in the same manner as in Example 1, except that the starting materials were changed as shown in Table 1. In Example 2, after a carrier core material was prepared by calcining, it was further heated at 500° C. to subject its surface to oxide coating treatment, whereby a carrier core material was prepared.

Then, a coated carrier was prepared in the same manner as in Example 1, except that the carrier core material obtained above was used.

Then, a two-component developing agent was prepared in the same manner as in Example 1, except that the coated carrier obtained above was used.

Properties of the carrier core materials and the coated carriers are set forth in Table 2. Properties of the two-component developing agents measured in the same manner as in Example 1 are set forth in Table 3.

According to "Metal Data Book" (edited by The Japan Institute of Metals), Ti has an electrical resistivity of $5.5\times10^{-5}$ Ω·cm.

TABLE 1

| | | Metal Oxide (MO) | | | Low-melting point oxide ($M^LO$) | | | High-melting point oxide ($M^HO$) | |
|---|---|---|---|---|---|---|---|---|---|
| Oxide | $Fe_2O_3$ | MnO | MgO | $SiO_2$ | $P_2O_5$ | $V_2O_5$ | $Bi_2O_3$ | $TiO_2$ | $ZrO_2$ |
| Melting point | | | | | 563° C. | 690° C. | 824° C. | 1843° C. | 2715° C. |
| Ex. 1 | 50 mol % | 47 mol % | 3 mol % | — | — | — | 3 wt. parts | — | 3 wt. parts |
| Ex. 2 | 50 mol % | 48 mol % | 2 mol % | — | — | — | 0.5 wt. | — | 0.5 wt. |

TABLE 1-continued

| | | Metal Oxide (MO) | | | Low-melting point oxide ($M^L O$) | | | High-melting point oxide ($M^H O$) | |
|---|---|---|---|---|---|---|---|---|---|
| Oxide | $Fe_2O_3$ | MnO | MgO | $SiO_2$ | $P_2O_5$ | $V_2O_5$ | $Bi_2O_3$ | $TiO_2$ | $ZrO_2$ |
| Ex. 3 | 50 mol % | 45 mol % | 5 mol % | — | — | — | 0.5 wt. part | — | 3 wt. part |
| Comp. Ex. 1 | 50 mol % | 45 mol % | 5 mol % | — | — | — | — | — | — |
| Comp. Ex. 2 | 50 mol % | 45 mol % | 5 mol % | — | 6 wt. parts | — | — | — | — |
| Comp. Ex. 3 | 50 mol % | 45 mol % | 5 mol % | — | — | — | — | 6 wt. parts | — |
| Comp. Ex. 4 | 80 mol % | 20 mol % | — | 2.0 wt. parts | — | — | 0.5 wt. part | — | — |

TABLE 2

| | Composition | | Magnetic properties (core material/ coated carrier) | | | | | Electrical resistivity | | | Average particle diameter (μm) (core material/ coated carrier) | 635-Mesh passing ratio |
|---|---|---|---|---|---|---|---|---|---|---|---|---|
| | $(M^L O)/(M^H O)$ | $(M^L O) + (M^H O)$ | Magnetization (Ms) | Residual magnetization (Mr) | Coercive force (Mc) | Oxide coating film | Coating resin | Before oxide coating treatment | After oxide coating treatment | After resin coating | | |
| Ex. 1 | 1.00 | 6.0 wt. % | 64/64 | 2/2 | 12/12 | not formed | silicone | $6.3 \times 10^7$ Ω · cm | — | $2.5 \times 10^{11}$ Ω · cm | 42.1/43.3 | 1.1 |
| Ex. 2 | 1.00 | 1.0 wt. % | 76/76 | 1/1 | 7/7 | formed | silicone | $5.1 \times 10^5$ Ω · cm | $6.9 \times 10^7$ Ω · cm | $1.2 \times 10^{10}$ Ω · cm | 35.2/36.3 | 0.6 |
| Ex. 3 | 0.17 | 3.5 wt. % | 70/70 | 2/2 | 12/12 | not formed | silicone | $5.4 \times 10^6$ Ω · cm | — | $6.3 \times 10^{10}$ Ω · cm | 55.2/56.9 | 0.8 |
| Comp. Ex. 1 | — | — | 70/70 | 3/3 | 12/12 | not formed | silicone | breakdown | — | $4.2 \times 10^5$ Ω · cm | 37.2/38.9 | 3.5 |
| Comp. Ex. 2 | — | 6.0 wt. % | 58/58 | 6/6 | 32/32 | not formed | silicone | breakdown | — | $8.1 \times 10^4$ Ω · cm | 85.2/86.4 | 0.5 |
| Comp. Ex. 3 | — | 6.0 wt. % | 62/62 | 4/4 | 28/28 | not formed | silicone | breakdown | — | $3.6 \times 10^6$ Ω · cm | 25.3/28.4 | 11.3 |
| Comp. Ex. 4 | — | 0.5 wt. % | 55/55 | 7/7 | 35/35 | not formed | silicone | breakdown | — | $4.9 \times 10^6$ Ω · cm | 32.5/34.6 | 4.5 |

TABLE 3

| | Solid uniformity | Halftone uniformity | Carrier adhesion | Gradation | Resolution | Overall evaluation |
|---|---|---|---|---|---|---|
| Ex. 1 | AA | BB | BB | BB | BB | BB |
| Ex. 2 | AA | AA | AA | AA | AA | AA |
| Ex. 3 | BB | BB | BB | AA | BB | BB |
| Comp. Ex. 1 | DD | DD | CC | DD | CC | DD |
| Comp. Ex. 2 | EE | EE | EE | EE | EE | EE |
| Comp. Ex. 3 | DD | CC | EE | CC | DD | DD |
| Comp. Ex. 4 | EE | EE | EE | DD | DD | DD |

What is claimed is:

1. A coated carrier comprising a carrier core material and a resin coating layer with which the carrier core material is coated, wherein the carrier core material consists essentially of a ferrite component having composition represented by the following formula (A):

$$(MO)_y(Fe_2O_3)_z \quad (A)$$

wherein y and z are each expressed in % by mol and are numbers satisfying the conditions of $40 \leqq z < 100$ and $y+z=100$, M is a metal selected from Fe, Cu, Zn, Mn, Mg, Ni, Sr, Ca and Li, and MO is one or more oxides selected from oxides of these metals, at least one metal oxide ($M^L O$) having a melting point of not higher than 1000° C. and at least one metal oxide ($M^H O$) having a melting point of not lower than 1800° C., wherein the metal oxide ($M^H O$) and the metal oxide ($M^L O$) are contained in the ferrite component, the metal oxide ($M^H O$) is at least one metal oxide selected from the group consisting of $ZrO_2$, $TiO_2$ and $Ta_2O_5$, and the metal oxide ($M^L O$) is at least one metal oxide selected from the group consisting of $Bi_2O_3$ and $P_2O_5$, a part of the metal oxide ($M^H O$) is independently present in the carrier core material for forming the coated carrier, a coercive force (Hc) of the carrier core material is not more than 50 Oe and the carrier core material has an average particle diameter of 15 to 70 μm.

2. The coated carrier as claimed in claim 1, wherein the metal ($M^H$) for constituting the metal oxide ($M^H O$) has an electrical resistivity of not less than $10^{-5}$ Ω·cm.

3. The coated carrier as claimed in claim 1, wherein the metal oxide (MO) is at least one metal oxide selected from the group consisting of FeO, MnO, MgO, CaO, $Li_2O$ and SrO.

4. The coated carrier as claimed in claim 1, wherein the weight ratio ($(M^L O)/(M^H O)$) of the metal oxide ($M^L O$) to the metal oxide ($M^HO$) contained in the carrier core material for forming the coated carrier is in the range of 0.01 to 50.

5. The coated carrier as claimed in claim 1, wherein the total content (($M^LO$)+($M^HO$)) by weight of the metal oxide ($M_LO$) and the metal oxide ($M^HO$) in the carrier core material for forming the coated carrier is in the range of 0.02 to 24% by weight.

6. The coated carrier as claimed in claim 1, wherein the metal oxide ($M^HO$) is contained inside the particle of the carrier core material for forming the coated carrier in a concentration higher than that in the vicinity of the surface of the particle thereof.

7. The coated carrier as claimed in claim 1, wherein the melting point of the metal oxide ($M^LO$) is in the range of 550 to 900° C. and the melting point of the metal oxide ($M^HO$) is in the range of 1800 to 3500° C.

8. The coated carrier as claimed in claim 1, wherein the carrier core material is coated with 0.01 to 10 parts by weight of a resin based on 100 parts by weight of the carrier core material.

9. The coated carrier as claimed in claim 1, having an average particle diameter of 15 to 70 μm.

10. The coated carrier as claimed in claim 1, having an electrical resistivity of not less than $10^7$ Ω·cm.

11. The coated carrier as claimed in claim 1, having no heat history of being heated to a temperature higher than the melting point of the metal oxide ($M^HO$) contained in the carrier core material for forming the coated carrier.

12. The coated carrier as claimed in claim 1, wherein the carrier core material for forming the coated carrier has an electrical resistivity of not less than $10^2$ Ω·cm.

13. The coated carrier as claimed in claim 1, having a magnetization, at 1000 ($10^3/4\pi$·A/m) (1000 oersted), of 40 to 100 $Am^2/kg$ (40to 100 emu/g).

14. The coated carrier as claimed in claim 1, wherein the resin for forming the coated carrier is a silicone type thermosetting resin.

15. A two-component developing agent for electrophotography, comprising the coated carrier of claim 1 and toner particles having an average particle diameter of 3 to 15 μm.

16. The coated carrier as claimed in claim 1, wherein the metal oxide ($M^LO$) is $Bi_2O_3$.

17. The coated carrier as claimed in claim 1, wherein the metal oxide ($M^HO$) is $ZrO_2$.

18. The coated carrier as claimed in claim 1, wherein the metal oxide ($M^LO$) is $Bi_2O_3$ and the metal oxide ($M^HO$) is $ZrO_2$.

* * * * *

UNITED STATES PATENT AND TRADEMARK OFFICE

CERTIFICATE OF CORRECTION

PATENT NO. : 7,553,597 B2
APPLICATION NO. : 10/773559
DATED : June 30, 2009
INVENTOR(S) : Kobayashi et al.

It is certified that error appears in the above-identified patent and that said Letters Patent is hereby corrected as shown below:

Column 25, Line 5, "($M_L$O) and the metal oxide" should read
-- ($M^L$O) and the metal oxide --

Signed and Sealed this

Twenty-ninth Day of September, 2009

David J. Kappos

David J. Kappos
*Director of the United States Patent and Trademark Office*